US011318699B2

(12) United States Patent
Slovencik

(10) Patent No.: US 11,318,699 B2
(45) Date of Patent: May 3, 2022

(54) DEVICE FOR PROVIDING PADDING MATERIAL FOR PACKAGING PURPOSES, AND FORMING UNIT FOR SUCH A DEVICE

(71) Applicant: Storopack Hans Reichenecker GMBH, Metzingen (DE)

(72) Inventor: Jean-Marc Slovencik, Uhrwiller (FR)

(73) Assignee: Storopack Hans Reichenecker GMBH, Metzingen (DE)

( * ) Notice: Subject to any disclaimer, the term of this patent is extended or adjusted under 35 U.S.C. 154(b) by 29 days.

(21) Appl. No.: 16/609,673

(22) PCT Filed: Feb. 22, 2018

(86) PCT No.: PCT/EP2018/054359
§ 371 (c)(1),
(2) Date: Oct. 30, 2019

(87) PCT Pub. No.: WO2018/202338
PCT Pub. Date: Nov. 8, 2018

(65) Prior Publication Data

US 2020/0061951 A1 Feb. 27, 2020

(30) Foreign Application Priority Data

May 2, 2017 (DE) ..... 10 2017 109 330.3

(51) Int. Cl.
*B31D 5/00* (2017.01)
*B65H 45/107* (2006.01)

(52) U.S. Cl.
CPC ..... *B31D 5/0043* (2013.01); *B31D 5/0052* (2013.01); *B65H 45/107* (2013.01);
(Continued)

(58) Field of Classification Search
CPC .. B31D 5/0052; B31D 5/0039; B31D 5/0047; B31D 5/0043; B31D 2205/0047;
(Continued)

(56) References Cited

U.S. PATENT DOCUMENTS 3,603,216 A * 9/1971 Johnson ..... B65D 81/051 493/359
4,557,716 A * 12/1985 Ottaviano ..... B31D 5/0047 242/557

(Continued)

FOREIGN PATENT DOCUMENTS

CA 2187195 A1 10/1995
DE 695 05 513 T2 5/1999

(Continued)

OTHER PUBLICATIONS

PCT/EP2018/054359 International Search Report dated Apr. 10, 2019.

(Continued)

*Primary Examiner* — Thomas M Wittenschlaeger
(74) *Attorney, Agent, or Firm* — Wood Herron & Evans LLP

(57) ABSTRACT

The invention relates to a device for providing cushioning material for packaging purposes, comprising a converting unit for turning over at least one lateral edge of a web-type starting material in the direction of a center of the starting material, creating an intermediate product, and a crumpling mechanism for crumpling the intermediate product into the cushioning material. According to the invention, the housing has a first coupling portion, which is complementary to a corresponding second coupling portion of the converting unit, and the converting unit is one of a set of at least two converting units, wherein the converting units of a set all have the same second coupling portion, and wherein the
(Continued)

converting units of a set are designed to convert different starting materials.

9 Claims, 4 Drawing Sheets

(52) U.S. Cl.
CPC ..... *B31D 2205/0035* (2013.01); *B31D 2205/0047* (2013.01); *B31D 2205/0082* (2013.01)

(58) Field of Classification Search
CPC .... B31D 2205/0082; B31D 2205/0058; B31D 2205/0035; B31D 2205/0005; B31D 2205/0011; B31D 2205/0017; B31D 2205/0023; B31D 2205/0041; B31D 2205/0076; B65H 45/107
See application file for complete search history.

(56) References Cited

U.S. PATENT DOCUMENTS

| | | | | | |
|---|---|---|---|---|---|
| 4,650,456 | A * | 3/1987 | Armington | B31D 5/0047 | 242/557 |
| 4,717,613 | A * | 1/1988 | Ottaviano | B31D 5/0047 | 156/493 |
| 4,884,999 | A * | 12/1989 | Baldacci | B31D 5/0047 | 493/439 |
| 5,504,555 | A * | 4/1996 | Yamamoto | G03B 27/588 | 355/29 |
| 5,593,376 | A * | 1/1997 | Armington | B31D 5/0047 | 493/346 |
| 5,674,172 | A * | 10/1997 | Armington | B31D 5/0047 | 493/22 |
| 5,803,893 | A * | 9/1998 | Armington | B31D 5/0047 | 248/676 |
| 5,899,649 | A * | 5/1999 | Kohtani | B42C 9/0075 | 412/11 |
| 5,908,375 | A * | 6/1999 | Simmons | B31D 5/0047 | 493/346 |
| 5,934,167 | A * | 8/1999 | Yamamoto | G03B 27/588 | 83/650 |
| 5,938,580 | A * | 8/1999 | Siekmann | B31D 5/0047 | 493/38 |
| 6,402,674 | B1 * | 6/2002 | Simmons, Jr | B31D 5/0047 | 493/24 |
| 6,421,985 | B1 * | 7/2002 | Simmons, Jr | B31D 5/0047 | 53/472 |
| 6,626,812 | B1 * | 9/2003 | Harding | B31D 5/0047 | 493/350 |
| 8,419,605 | B2 * | 4/2013 | Keller | B65H 19/126 | 493/464 |
| 8,671,651 | B2 * | 3/2014 | Poutot | B65B 43/285 | 53/398 |
| 8,920,299 | B2 * | 12/2014 | Keller | B31D 5/0043 | 493/464 |
| 9,321,235 | B2 * | 4/2016 | Cheich | B31D 5/0043 | |
| 10,625,484 | B2 * | 4/2020 | Chan | B65H 20/16 | |
| 2010/0300639 | A1 | 12/2010 | Keller | | |
| 2017/0066215 | A1 * | 3/2017 | Cheich | B31D 5/0047 | |
| 2020/0094511 | A1 * | 3/2020 | Peterlini | B31D 5/0047 | |

FOREIGN PATENT DOCUMENTS

| | | | |
|---|---|---|---|
| DE | 695 09 098 | T2 | 10/1999 |
| DE | 10 2006 059 638 | A1 | 6/2008 |
| FR | 2808726 | A1 | 11/2001 |
| GB | 2 508 267 | A | 5/2014 |
| GB | 2 522 637 | A | 8/2015 |
| WO | 1996/03273 | A1 | 2/1996 |
| WO | 2015/168612 | A1 | 11/2015 |

OTHER PUBLICATIONS

German Application 10 2017 109 330.3 Examination Report dated Nov. 15, 2017.
PCT/EP201 8/054359 Wirtten Opinion dated Apr. 10, 2019.

* cited by examiner

DEVICE FOR PROVIDING PADDING MATERIAL FOR PACKAGING PURPOSES, AND FORMING UNIT FOR SUCH A DEVICE

The invention relates to a device for providing cushioning material for packaging purposes, as well as a converting unit for such a device.

For example, from DE 10 2012 222 805 B3 it is known to produce a cushioning material for packaging purposes by converting a substantially web-type starting material in a converting unit, initially by striking adjacent edge regions to an intermediate product which is star-like in cross-section, which is then fed to a crumpling mechanism, in which the intermediate product is crumpled in its longitudinal direction, thereby converting the cushioning material. Under the trade name "PAPERplus Classic" of the applicant, a cushioning material made of paper and corresponding devices for providing this cushioning material are also known, wherein said cushioning material is substantially produced according to DE 10 2012 222 805 B3, but wherein the starting material is flat, and wherein, in the converting unit, the two side edges of the web-type starting material are turned over by 180° in the direction of a center of the starting material.

The object of the present invention is to develop a device of the type mentioned above such that it can be inexpensively manufactured and easily transported.

This object is achieved by a device having the features of claim 1, as well as by a converting unit having the features of the independent claim. Advantageous further developments of the invention are specified in subclaims. In addition, the invention discloses essential features in the following description and in the accompanying drawings, wherein these features may be essential both in isolation and in different combinations for the invention, without being referred to again in detail.

In the device according to the invention, a converting unit is provided for turning over at least one lateral edge of a web-type starting material, for example consisting of paper, in the direction of a center of the starting material, whereby an intermediate product is formed. Further, the device comprises a crumpling mechanism disposed in a housing for crumpling the intermediate product in the longitudinal direction thereof, thereby forming the cushioning material, and a dispensing region for dispensing the cushioning material. The housing has a first coupling portion which is complementary to a corresponding second coupling portion of the converting unit. The converting unit is one of a set of at least two separately operable and interchangeable converting units, wherein the converting units of a set all have the same second coupling portion, and wherein the converting units of a set are designed to convert different starting materials.

The device according to the invention is therefore of modular design: to the same or even selfsame housing, which comprises the crumpling mechanism, or to the first coupling portion provided there, respectively, very different converting units can be coupled alternatively. The converting units are members of a set of converting units, wherein all the converting units of the set have at least one commonality, namely an identical second coupling portion, so that each converting unit of the set of converting units can be coupled to the first coupling portion of the housing in the same manner. The converting units are thus designed as separately manageable and mutually interchangeable cassettes.

As a result, the production of the device according to the invention is simplified because for many different applications, the same housing can always be used with the same crumpling mechanism, and only different converting units must be designed and manufactured. In addition, the transport of the device according to the invention is simplified, since for transport, the converting unit can be detached from the housing, whereby the dimensions of the individual components to be transported are reduced, and also the weight of the individual components to be transported is reduced.

In a first further development of the device according to the invention, it is proposed that the converting units of a set are designed for converting starting materials of different widths. The width of the starting material essentially influences the density and thus the rigidity of the finished cushioning material. With the same combination of housing and crumpling mechanism, a cushioning material with different density or stiffness can thus be produced by simply exchanging the converting unit and feeding a corresponding other web-type starting material.

Furthermore, it is possible that the converting units of a set are designed for converting starting materials of different types. For example, the starting material may be a single-ply flat strip of material, a multi-ply flat strip of material, or a multi-ply strip of material whose layers are joined in the middle, etc.

A further embodiment of the invention provides that the second coupling portion of a converting unit has an outlet channel for the intermediate product, which can be inserted into a corresponding retainer in the housing, which belongs to the first coupling portion. This allows for a very simple coupling of the converting unit with the housing.

It is also possible that the converting unit is screwed and/or latched to the housing. As a result, the converting unit is securely held on the housing.

It is particularly advantageous if the converting unit has at least one first receiving space in which the web-type starting material is converted into the intermediate product and which has a longitudinal extension and wherein the first transverse extension decreases in the direction of the longitudinal extension in at least a portion of the longitudinal extension, and wherein the first receiving space has at least one lateral edge region, seen in the direction of the first transverse extension, wherein said space is bent at an angle, which is greater than about 150°, more preferably about equal to 180°. With such a converting unit, therefore, an intermediate product is produced which has at least one edge portion which is turned over inwards, toward the center, by at least 150°, preferably by 180°. Such an intermediate product can then be deconverted in the crumpling mechanism to a very effective and versatile cushioning product. The converting is done very reliably thanks to the specific design. In particular, the risk of a material jam is considerably reduced.

In a further development, it is proposed that the converting unit has a second receiving space parallel to a second transverse extension which is orthogonal to the first transverse extension, wherein said second receiving space is arranged in mirror image to the first receiving space, wherein the first receiving space and the second receiving space are interconnected by a slot-like opening extending in the direction of the longitudinal extension. By means of such a converting unit, a web-type starting material can be converted, which has two layers which are interconnected in a longitudinally extending central region. Overall, an intermediate product is produced in this way having four lateral edges which are preferably turned over inwards by 180°. Such an intermediate product can be converted by the crumpling mechanism into a very large volume of cushioning material with excellent cushioning properties.

In order not to hinder the turning over of the lateral edges of the web-type starting material in the converting unit, it is finally proposed according to the invention that a receiving space is delimited by two walls which are substantially parallel to one another and at least partially parallel, which are connected to one another in a region which lies outside the receiving space.

Hereinafter, one embodiment of the invention will be explained with reference to the accompanying drawing. in which.

Figure 1:
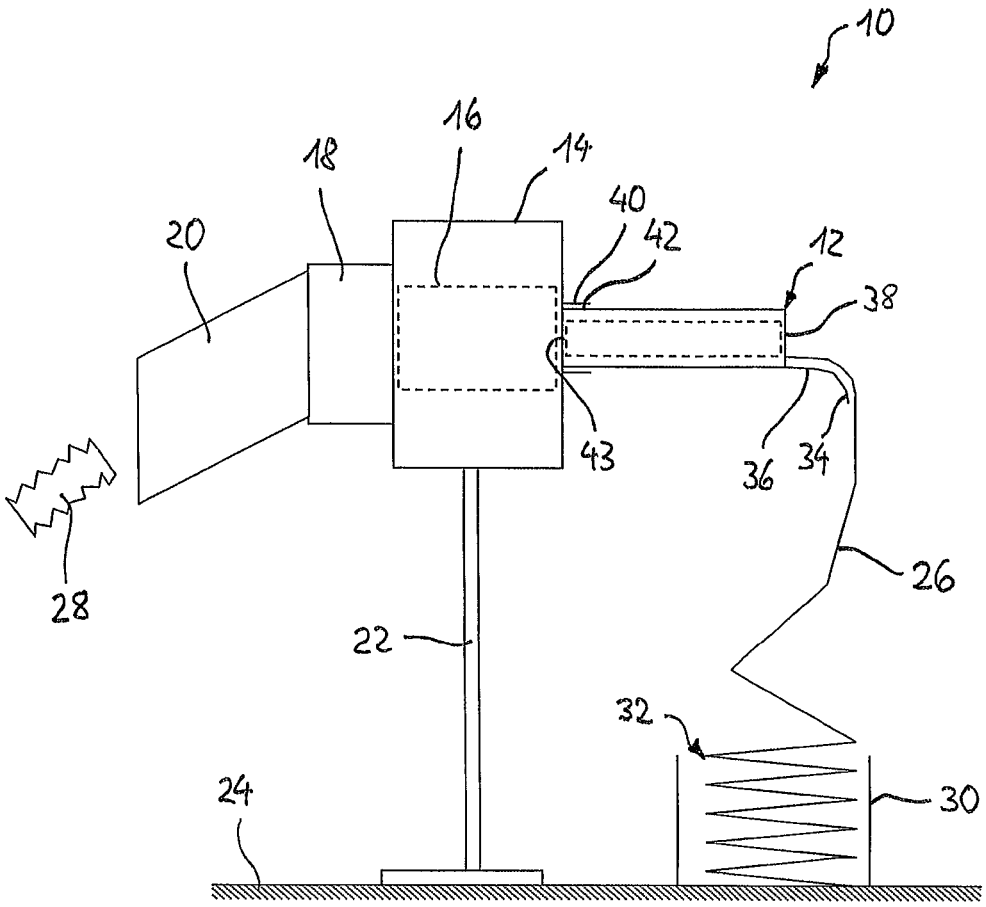
FIG. 1 shows a schematic side view of a device for providing cushioning material for packaging purposes.

A device for providing cushioning material for packaging purposes has generally the reference numeral 10 in FIG. 1. It comprises a converting unit 12, a housing 14 having a crumpling mechanism 16 arranged therein, a separating device designed as a cutting device 18 for separating generated cushioning pads from a residual material still present in the crumpling mechanism 16, and a dispensing region 20 for dispensing the cushioning pads to a user. The converting unit 12 comprises a housing 21 and a converting portion 23. The housing 14 is placed on a stand 22 on a floor 24.

By means of the device 10, a web-type starting material 26 is converted into a cushioning material 28. The web-type starting material 26 may be made of paper, for example. It is stored in a container 30 as a zigzag folded stack 32. From there, the web-type starting material 26 passes via an inlet plate 36 provided with a curved edge 34 into an inlet region 38 of the converting unit 12. The inlet plate 36 is fixedly connected to the converting unit 12. In one embodiment, not shown, instead of the inlet plate with the curved edge, a round tube arranged transversely to the conveying direction can simply be used.

The housing 14 has a first coupling portion 40, which is complementary to a corresponding second coupling portion 42 of the converting unit 12. The first coupling portion 40 is designed as a retainer in the housing 14, in which the converting unit 12 can be inserted. For example, via a screw or a latch (not shown), the converting unit 12 can be fixed with the housing 14, while still being releasably connected in a non-destructive manner. Via an outlet region 43, an intermediate product emerging from the converting unit 12 enters the crumpling mechanism 16.

Figure 2:
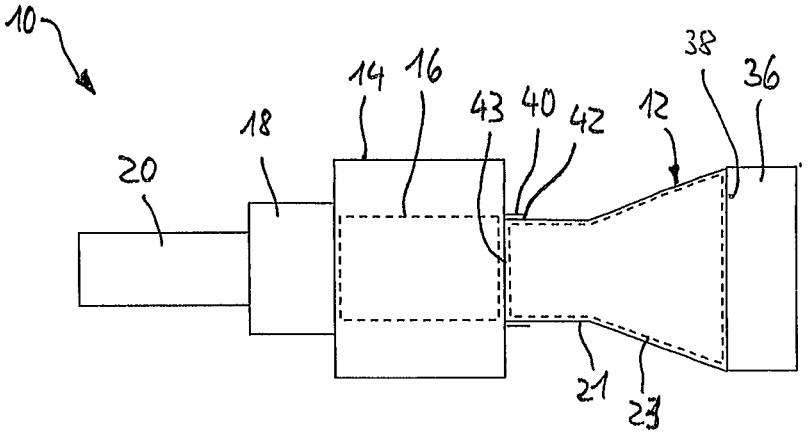
FIG. 2 shows a schematic plan view of the device of FIG. 1 having a first converting unit of a set of converting units.
Figure 3:
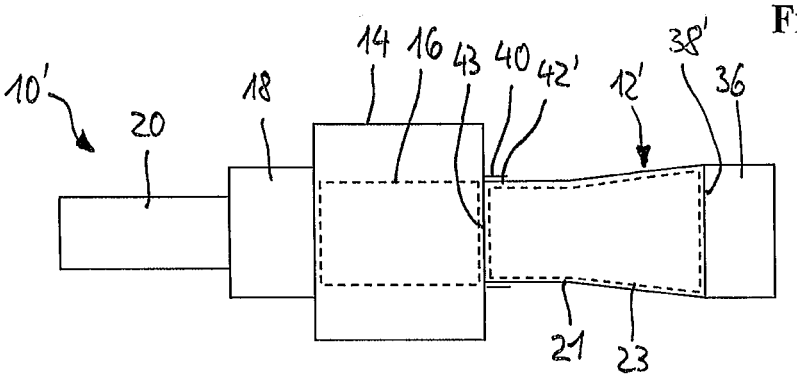
FIG. 3 shows a view similar to FIG. 2, but having a second converting unit of the set of converting units.
Figure 4:
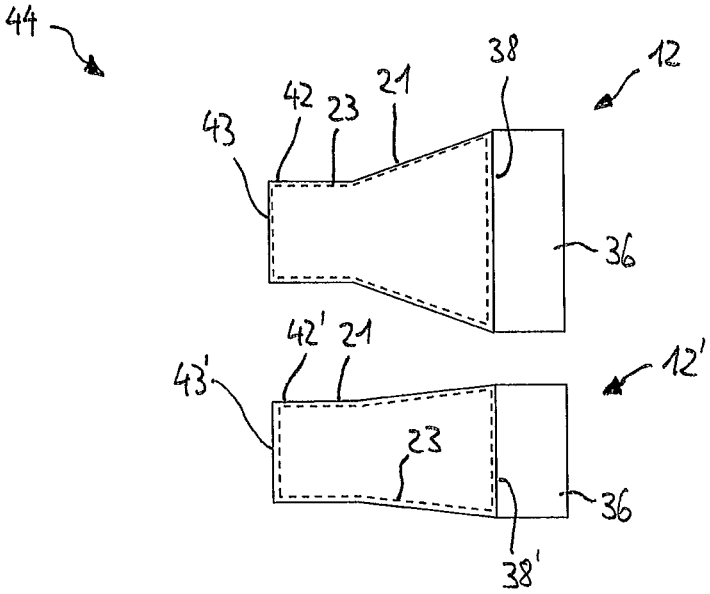
FIG. 4 shows a schematic plan view of the set of converting units.

As can be seen from FIGS. 2 to 4, the converting unit 12 is a member of a set 44 of, in the present embodiment, two converting units 12 and 12'. It is understood that in other embodiments, the set of converting units may also have more than two converting units. The converting units 12 and 12' of the set 44 all have the same second coupling portion 42. All converting units 12 and 12' of the set 44 can be connected to the extent of the first coupling portion 40 to the housing 14.

However, it can be seen from FIGS. 2-4 that the converting units 12 and 12' differ from one another in that they are designed for converting web-type starting materials 26 and 26' of different width. While the converting unit 12 is designed for converting a relatively wide web-type starting material 26, the converting unit 12' is designed for converting a relatively narrow web-type starting material 26. This is shown inter alia by the fact that the inlet region 38 of the converting unit 12 in the plan view shown in FIGS. 2 to 4 is considerably wider than the inlet region 38' of the converting unit 12'. The width of the converting unit 12 thus decreases considerably more from the inlet region 38 to the second coupling portion 42 than the width of the converting unit 12' from the inlet region 38' to the second coupling portion 42'.

In one embodiment, not shown, the converting units of a set differ at least also in that they are designed for converting starting materials of different types. For example, a converting unit of the set for converting a single-ply web-type starting material can be designed by turning over of only one lateral edge, whereas another converting unit of the set is designed for converting a two-ply web-type starting material and by turning over all four lateral edges.

It can be seen from FIGS. 2 to 4 that the converting units 12 and 12' of the set 44 are cassette-type parts that are mutually interchangeable and that can be handled separately from the housing 14, and that either the converting unit 12 or the converting unit 12' can be detachably mounted on said or at least on the same housing 14 or the first coupling portion 40 present there.

Figure 5:
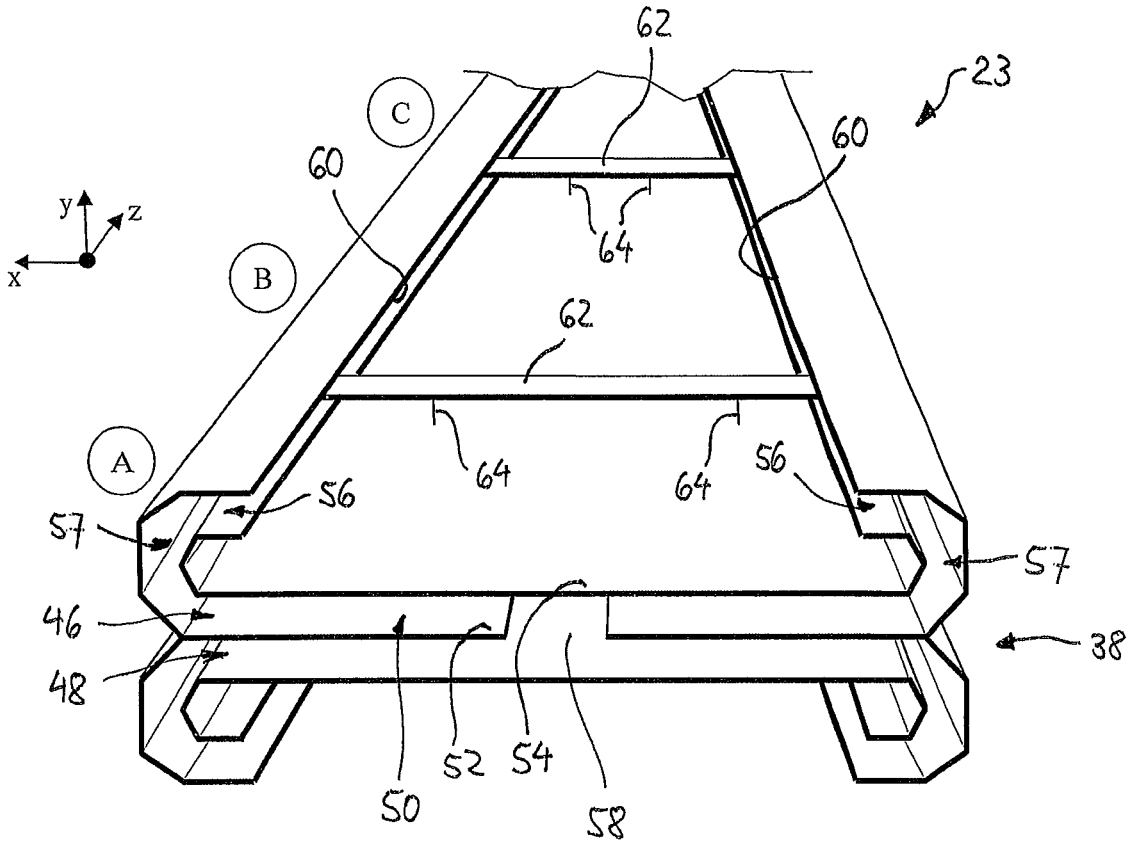
FIG. 5 shows a schematic perspective view of a typical converting unit of the set of converting units.

An embodiment of the converting unit 12 will now be described in detail with reference to FIGS. 5 to 8. FIG. 5 shows the converting portion 23 without the housing 21 in perspective from the inlet region 38 in the direction of the outlet region, which is not shown in FIG. 5. The converting portion 43 has a first receiving space 46 and a second receiving space 48. Their function will be explained in more detail below. The first receiving space 46 has a central region 50 which extends relatively long in a first transverse extension x and which is relatively flat in a second transverse extension y (the second transverse extension y and the first transverse extension x are mutually orthogonal). It is delimited by two walls 52 and 54 that are substantially parallel to one another and at least partially parallel.

Two outer lateral edge regions 56 of the first receiving space 46 are initially bent upward in the direction of the second transverse extension y and then a short distance inwards in the direction of a center of the central region 50. The bend, which carries the reference numeral 57 in the figure, thus is a total of about 180°. In another embodiment, however, it could also be smaller, for example approximately 150°. In the edge regions 56, the first receiving space 46 is open to the outside.

The second receiving space 48 is arranged opposite the second transverse extension y as viewed from the first receiving space 46, and is arranged and designed in mirror image relative to the first receiving space 46. The mirroring plane is thereby spanned by the lower wall 52 of the receiving space 46 in FIG. 5 and a longitudinal extension z of the converting unit 12. For reasons of clarity, the second receiving space 48 is not provided with reference numerals in the figures. It is basically identical to the first receiving space 46.

The two receiving spaces 46 and 48 are connected by a slot-like opening 58 in the wall 52 delimiting the two receiving spaces 46 and 48, the opening 58 extending in the direction of the longitudinal extension z. The two walls 52 and 54 are held relative to each other as follows: opposing edges 60 of the first wall 52 in the edge region 56 are connected by two flat web-type crosspieces 62, for example by welding. From these, two pin-like holders 64 project to the second wall 54. The pin-like holder 64 may, for example, be screwed to the crosspieces 62 and welded to the wall 54. In this way, the two walls 52 and 54 are held or connected to one another, in a rigid and immovable manner, in a region which is outside of the receiving space 46.

Figure 6:
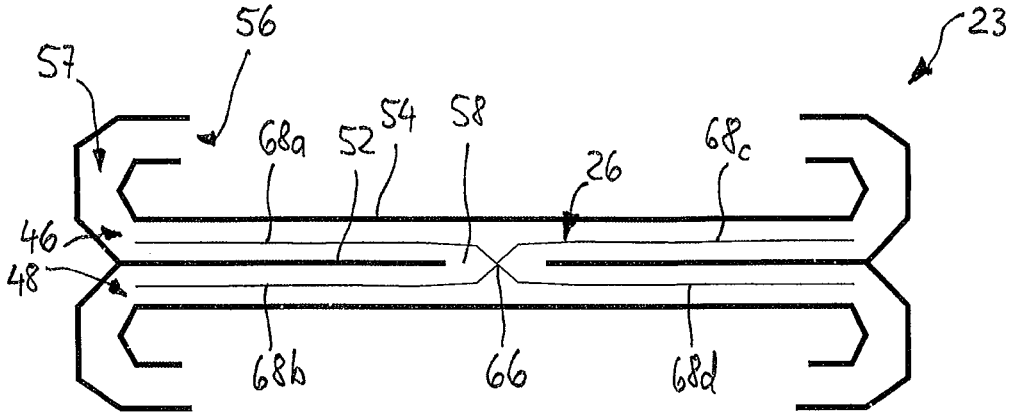
FIG. 6 shows a schematic section through the converting unit of FIG. 5 in a first sectional plane A of FIG. 5.

It can be seen from FIGS. 5 to 8 that the width of the converting unit 12, that is to say its dimension parallel to the first transverse extension x, decreases in the course of the longitudinal extension z towards the outlet region 43. In the sectional plane C (FIG. 8), the width is thus smaller than in the sectional plane B (FIG. 7), and the width in the sectional plane B (FIG. 7) is again smaller than the width in the sectional plane A (FIG. 6).

The converting unit 12 functions as follows (FIGS. 6-8): the web-type starting material 26 is arranged in the converting unit 12 such that a central connecting region 66 lies in the region of the slot-like opening 58. Four "wings" 68*a-d* of the starting material 26 extending from the central connecting portion 66 are arranged in left and right portions of the receiving spaces 46 and 48 in the figures (cross-sectional position A corresponding to FIG. 6).

Figure 7:
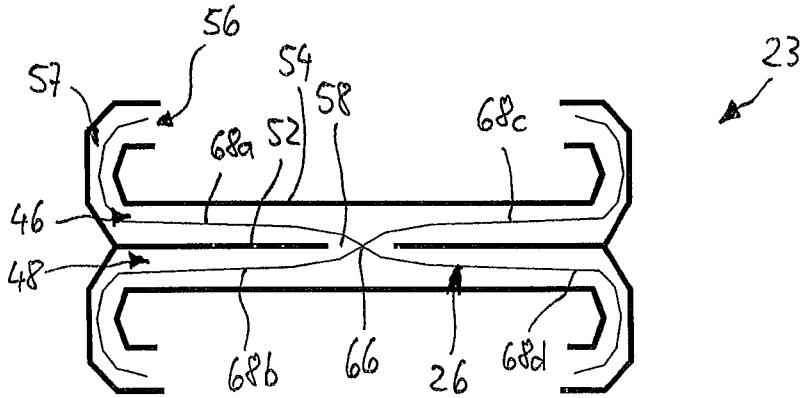
FIG. 7 shows a representation similar to FIG. 6 in a second sectional plane B of FIG. 5.
Figure 8:
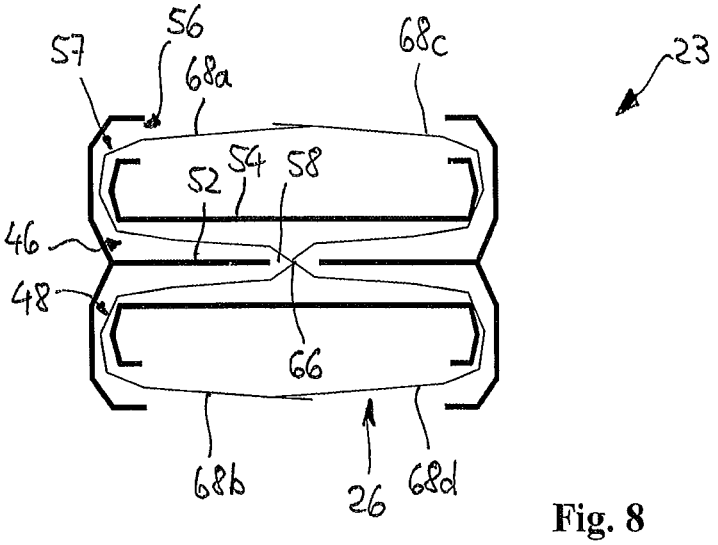
FIG. 8 shows a representation similar to FIG. 6 in a third sectional plane C of FIG. 5.

If now the web-type starting material 26 is moved along the longitudinal extension z, for example by driving the crumpling mechanism 16 by motor, the projecting edges of the wings 68*a-d* first migrate into the bend 57, whereby they are first turned upwards and then inwards (cross-sectional position B according to FIG. 7). In the further course of the movement, the projecting edges of the wings 68*a-d* emerge from the receiving spaces 46 and 48 until they overlap (cross-sectional position B according to FIG. 8).

In this way, an intermediate product which has approximately the shape of a flat 8 is provided in the outlet region 43 of the converting unit 12. This intermediate product is then introduced into the crumpling mechanism 16, which consists for example of two pairs of rollers, which are arranged one after another in a conveying direction and between the peripheral surfaces of which a passage gap is formed, wherein the rear pair of rollers, relative to the conveying direction, rotates slower than the front pair of rollers, relative to the conveying direction. After exiting the crumpling mechanism 16, the cutting device 18 is actuated, the feed being temporarily stopped by the crumpling mechanism 16, whereby the cushioning material 28 is dispensed from the output region 20 in the form of a cushioning pad.

In one embodiment (not shown), the device does not have a cutting device. Instead, the individual cushioning pads are separated in other ways: for example, in such a case, the web-type starting material has transversely extending perforation lines. By a corresponding control of the successively arranged pairs of rollers of the crumpling mechanism, a cushion is separated from the residual material. For example, the first pair of rollers, as seen in the conveying direction, can be stopped briefly, whereas the second pair of rollers, as seen in the conveying direction, continues to operate. As a result, the cushioning cushion held by the second pair of rollers is torn off from the remaining material which is still held in the first pair of rollers. In principle, however, it is also possible that the individual cushioning pads are torn off manually on the perforation line.

The invention claimed is:

1. A device for providing cushioning material for packaging purposes, having a converting unit for turning over at least one lateral edge of a web-type starting material in the direction of a center of the starting material and creating an intermediate product, a housing, and a crumpling mechanism arranged in the housing for crumpling the intermediate product into the cushioning material, wherein the housing has one single first coupling portion, which is complementary to a corresponding second coupling portion of the converting unit, wherein the converting unit is one of a set of at least two converting units, wherein the converting units of the set all have the same second coupling portion, are mutually interchangeable, can be handled separately from the housing, and can be detachably mounted on the same housing, and wherein the converting units of the set are designed to convert different starting materials, wherein the converting unit has at least one first receiving space in which the web-type starting material is converted into the intermediate product and which has a longitudinal extension, a first transverse extension, and a second transverse extension, and wherein the first transverse extension decreases in the direction of the longitudinal extension in at least a portion of the longitudinal extension, and wherein the first receiving space has two lateral portions, seen in the direction of the first transverse extension, wherein each of said lateral portions forms an angle which is greater about 150°, wherein the converting unit has a second receiving space arranged in mirror image to the first receiving space about a plane defined by the first transverse extension and the longitudinal extension, wherein the first receiving space and the second receiving space are interconnected by a slot opening extending in the direction of the longitudinal extension, and wherein the slot opening is configured so that the web-type starting material of the cushioning material is moved through the slot opening along the longitudinal extension by driving the crumpling mechanism by a motor.

2. The device according to claim 1, wherein the converting units of the set are designed for converting starting materials of different widths.

3. The device according to claim 1, wherein the converting units of the set are designed for converting starting materials of different types.

4. The device according claim 1, wherein the second coupling portion of the converting unit has an outlet region for the intermediate product, which can be inserted into a corresponding retainer in the housing, wherein said retainer belongs to the first coupling portion.

5. The device according to claim 1, wherein the converting unit is screwed and/or latched to the housing.

6. The device according to claim 1, wherein the at least one first receiving space is delimited by two walls which are substantially mutually parallel, and which are held relative to each other in a region outside the receiving space.

7. The device according to claim 1, wherein the angle is about equal to 180°.

8. The device according to claim 1, wherein the second receiving space also has two lateral portions, seen in the direction of the first transverse extensions, wherein each of the said lateral portions forms an angle which is greater than 150°.

9. Set of converting units for turning over at least one lateral edge of a web-type starting material in the direction of a center of the starting material, wherein the converting units have a second coupling portion with which they can be coupled to a complementary first coupling portion of a housing of a device for providing cushioning material for packaging purposes, wherein the converting units of the set all have the same second coupling portion and that the converting units of the set are designed for converting different starting materials, wherein each of the converting units has at least one first receiving space in which the web-type starting material is converted into the intermediate product and which has a longitudinal extension, a first transverse extension, and a second transverse extension, and wherein the first transverse extension decreases in the direction of the longitudinal extension in at least a portion of the longitudinal extension, and wherein the first receiving space has two lateral portions, seen in the direction of the first transverse extension, wherein each of said lateral portions forms an angle which is greater than 150°, wherein each of the converting units has a second receiving space arranged in mirror image to the first receiving space about a plane defined by the first transverse extension and the longitudinal extension, wherein the first receiving space and the second receiving space are interconnected by a slot opening extending in the direction of the longitudinal extension, and wherein the slot opening is configured so that the web-type starting material of the cushioning material is moved through the slot opening along the longitudinal extension by driving the crumpling mechanism by a motor.

* * * * *